US005233364A

United States Patent [19]

Lefeuvre et al.

[11] Patent Number: 5,233,364

[45] Date of Patent: Aug. 3, 1993

[54] DUAL-POLARIZED MICROWAVE ANTENNA ELEMENT

[75] Inventors: Pascal Lefeuvre, Frouzins; Denis Michel, Saint Jean l'Herm; Jacques Bigou, Toulouse, all of France

[73] Assignee: Alcatel Espace, Courbevoie, France

[21] Appl. No.: 895,846

[22] Filed: Jun. 9, 1992

[30] Foreign Application Priority Data

Jun. 10, 1991 [FR] France ..... 91 07027

[51] Int. Cl.[5] ..... H01Q 1/42

[52] U.S. Cl. ..... 343/789; 343/700 MS

[58] Field of Search ..... 343/767, 770, 789, 700 MS, 343/756, 786, 778, 909

[56] References Cited

U.S. PATENT DOCUMENTS

| | | | |
|---|---|---|---|
| 4,835,538 | 5/1989 | McKenna et al. | 343/700 MS |
| 4,929,959 | 5/1990 | Sorbello et al. | 343/700 MS |
| 5,005,019 | 4/1991 | Zaghloul et al. | 343/700 MS |
| 5,025,264 | 6/1991 | Stafford | 343/789 |

FOREIGN PATENT DOCUMENTS

| | | |
|---|---|---|
| 0123350 | 10/1984 | European Pat. Off. . |
| 0426972 | 5/1991 | European Pat. Off. . |
| 2603744 | 3/1988 | France . |

*Primary Examiner*—Michael C. Wimer
*Assistant Examiner*—Tan Ho
*Attorney, Agent, or Firm*—Sughrue, Mion, Zinn, Macpeak & Seas

[57] ABSTRACT

A microwave antenna element suitable for constituting one of the elements of an array, the antenna element being capable of transmitting or receiving two orthogonally-polarized microwaves. The antenna element is constituted by a cavity containing two orthogonal excitation probes separated by a polarization-selective obstacle forming both a short-circuit plane for the microwave transmitted by the top probe, and also a patch for the microwave transmitted by the bottom probe. Another patch is common to both of the interlaced antennas. A third patch which is polarization-selective in the sense that it is transparent for the microwave transmitted by the bottom probe, may also be provided.

4 Claims, 2 Drawing Sheets

DUAL-POLARIZED MICROWAVE ANTENNA ELEMENT

The present invention relates to a microwave antenna element, i.e. an antenna capable of operating on its own, of being one of the elements of an array of antennas, or of being used on its own or in an array as the primary source for an antenna system having a reflector or a focussing device, the antenna element being capable of operating with two orthogonal polarizations.

BACKGROUND OF THE INVENTION

Known antenna elements of this type are made by means of boards (often printed boards), each including two orthogonal feedlines which are generally coplanar and which are associated with one or two flat obstacles of the "patch" type comprising an "active" patch coupled to the two feedlines and optionally a "passive" other patch overlying the first patch and performing the function of spreading the passband.

Such known structures suffer from the major drawback of not allowing satisfactory decoupling to be achieved between the two orthogonal polarizations over a wide passband, thereby making it possible to achieve the characteristics of purity that are often currently desired.

In attempts to improve the performance levels of arrays of antennas of this type, the following has already been proposed:

separating the arrays of radiating elements electrically and physically so as to obtain one array for each of the two crossed polarizations;

geometrically interlacing the two resulting single-polarization radiating arrays to form one array; and grouping the radiating elements operating in dual-polarization mode together into well-defined sub-arrays fed via phase-shifters so as to cancel the cross-polarization radiation on the axis of the antenna.

However, all those ways of solving the problems do not make it possible to obtain arrays that are sufficiently compact and lightweight to be compatible with certain requirements, especially in the case of antennas on-board satellites. Moreover, as yet, the quality of polarization separation remains insufficient when a wide passband is desired.

SUMMARY OF THE INVENTION

An object of the invention is to remedy these drawbacks. To this end, the invention provides a microwave antenna element capable of operating with two orthogonally-polarized microwaves, said antenna element including a cavity that is open in the radiation direction, the cavity containing at least the following in succession, in the direction going from its bottom towards its opening:

a first excitation or pick-up member for exciting or picking up a first microwave polarized in a first direction, the excitation/pick-up member being placed in the vicinity of the bottom of the cavity;

a first resonant obstacle which is polarization-selective, and which is shaped to be an "active" resonator or radiator of the "patch" type for the first microwave, and, on the contrary, to be a short-circuit plane for a second microwave polarized in orthogonal manner relative to said first microwave;

a second excitation or pick-up member for exciting or picking up the second microwave; and a second resonant obstacle of the patch type which is not polarization-selective;

whereby said first resonant obstacle which is polarization-selective constitutes both an "active" radiator for said first microwave, and also a short-circuit plane forming the cavity bottom for said second microwave, while said second resonant element which is not polarization-selective constitutes both a "passive" radiator for the first microwave and also an "active" radiator for the second microwave.

Advantageously, downstream from said second resonant element and also in the cavity-bottom-to-cavity-opening radio transmission direction, the antenna element may further include at least a third resonant obstacle which is in turn a polarization-selective element and which is shaped so as to be transparent for the first microwave and, on the contrary, so as to constitute a "passive" radiator or resonator also of the patch type for said second microwave.

BRIEF DESCRIPTION OF THE DRAWINGS

An embodiment of the invention is described by way of example with reference to the accompanying drawings, in which.

DETAILED DESCRIPTION

Figure 1:
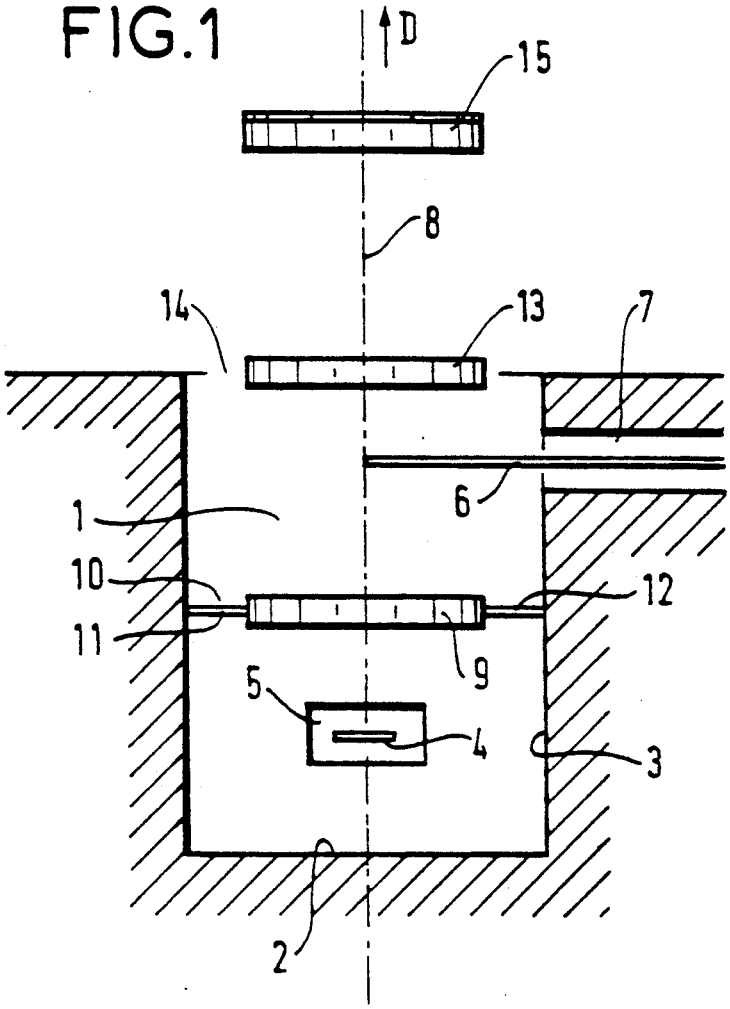
FIG. 1 is a view in vertical section of a theoretical embodiment of the antenna element.
Figure 2:
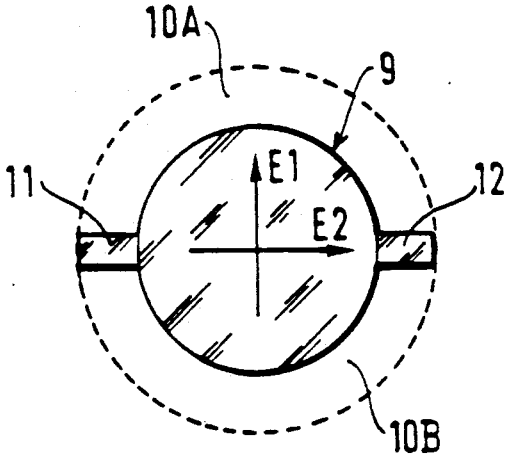
FIGS. 2 and 3 are plan views of the two polarization-selective elements which the antenna element is equipped.
Figure 3:
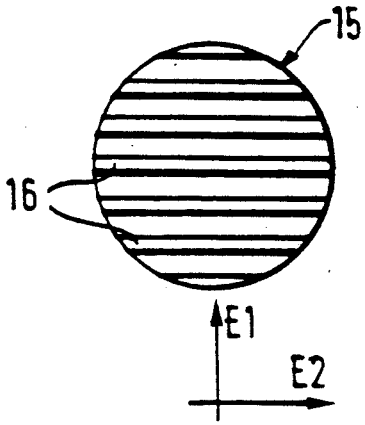

FIGS. 1 to 3 show a transmit/receive microwave antenna element capable of transmitting or receiving two distinct microwaves that are orthogonally polarized (the polarizations being linear, for example). The antenna element may naturally operate on its own, but is more typically designed to be part of an array of antennas, which array comprises a number (which may be more or less large) of antenna elements of the same or of differing types.

The antenna element is composed of a body provided with a cavity 1 (of circular cross-section in this example) having its bottom 2 and its circular sidewall 3 metal-plated. The cavity is totally open in the radiation transmission direction D so that it constitutes a blind hole as shown in FIG. 1.

The cavity may be filled with a dielectric material either partially or completely.

Two orthogonally-polarized microwaves are excited (or received) in the cavity 1.

A first one of the two microwaves is excited or picked up by a first probe 4 constituted by the core of a first stripline 5. The first probe is placed at about one quarter of the wavelength from the bottom of the cavity 1, is close to the cavity bottom surface 2, and is orthogonal to the axis 8 of the cavity 1.

The second one of the two microwaves is excited or picked up by a second probe 6 which is orthogonal to the first probe 4, and which is constituted by the core of a second stripline 7. The second probe 6 is contained in a plane which is orthogonal to the axis 8 of the cavity 1, and which is consequently parallel to the plane containing the first probe 4. The second probe is situated inside the cavity 1 at about one quarter of the wavelength from the first probe 4.

An obstacle 9 which is plane and orthogonal to the axis 8 is placed on the axis 8 between the first probe 4 and the second probe 6. The obstacle is shown in plan view in FIG. 2 and is polarization-selective in the sense that it constitutes a short-circuit plane orthogonal to the axis 8 for the microwave radiated or received by the top probe 6, while, for the microwave radiated or received by the bottom probe 4, it forms a plane circular obstacle, also referred to as a "patch", defining a non-looped radiating slot 10 constituted by at least two arcuate half-slots 10A, 10B which in this example are semicircular, are physically separated from each other, and are of the same radius.

In the embodiment in question, the selective patch 9 has a plane, almost circular shape, with two diametrically opposite "lugs" 11, 12 which electrically connect the central disk 9 to the circular sidewall 3 of the cavity 1. It then constitutes a short-circuit for the electric field E2, relative to the probe 6, which field is directed along the lugs 11 and 12, whereas it forms an almost circular patch for the electric field E1, orthogonal to the field E2, and relative to the probe 4.

Going further along the axis 8 in the direction D, there is the above-mentioned second probe 6 and then, above the second probe 6, there is an ordinary patch 13 co-operating with the cavity 1 to define a looped radiating slot 14, which ordinary patch 13 is level with the top opening of the cavity 1 in this embodiment.

Finally, above the ordinary patch 13, there is a patch 15 which is polarization-selective in the sense that it is designed to be transparent for a microwave of electric field E1 relative to the first probe 4, while it forms a true patch for a microwave of field E2 relative to the second probe 6. To this end, and as shown in FIG. 3, the selective patch 15 is constituted by a set of spaced parallel conductive wires 16 which are directed in the direction of the field E2.

The antenna element operates as follows:

The selective member 9 is a short-circuit for the microwave of field E2 which is transmitted or received by the top probe 6. For this microwave, the bottom of the cavity 1 is therefore constituted by the member 9, and furthermore, the patch 13 constitutes a first patch, conventionally referred to as an "active" patch, while the member 15, which behaves like a patch, acts as a "passive" patch whose main function is to spread the passband of the microwave signal transmitted or received by the top probe 6.

In contrast, for a microwave of field El which is transmitted or received by the bottom probe 4, the member 15 is totally transparent, and is therefore absent from the electrical point of view, while the member 9 acts as an active patch and the patch 13 is a passive patch for this microwave. In this design, the element 15 acts in the same way relative to the elements 6 and 13 as the element 13 does relative to the elements 5 and 9. The passband may be spread to different degrees depending on the performance levels required of the system.

It can be observed that the antenna element can transmit or receive two orthogonally-polarized microwaves E1, E2 without the two microwaves (which are entirely dissociated from each other electrically) interfering with each other.

The passbands of the microwaves can be sufficiently wide due to each of them being in the presence of a passive patch, respectively patch 13 for microwave E1 and patch 15 for microwave E2.

The antenna element has good characteristics as regards mass and compactness due to the fact that it is in fact constituted by two conventional antennas (each having a cavity, an active patch, and a passive patch) which are physically "interlaced" with each other, constituting, in fact, a multilayer geometrical structure having two different levels.

Figure 4:
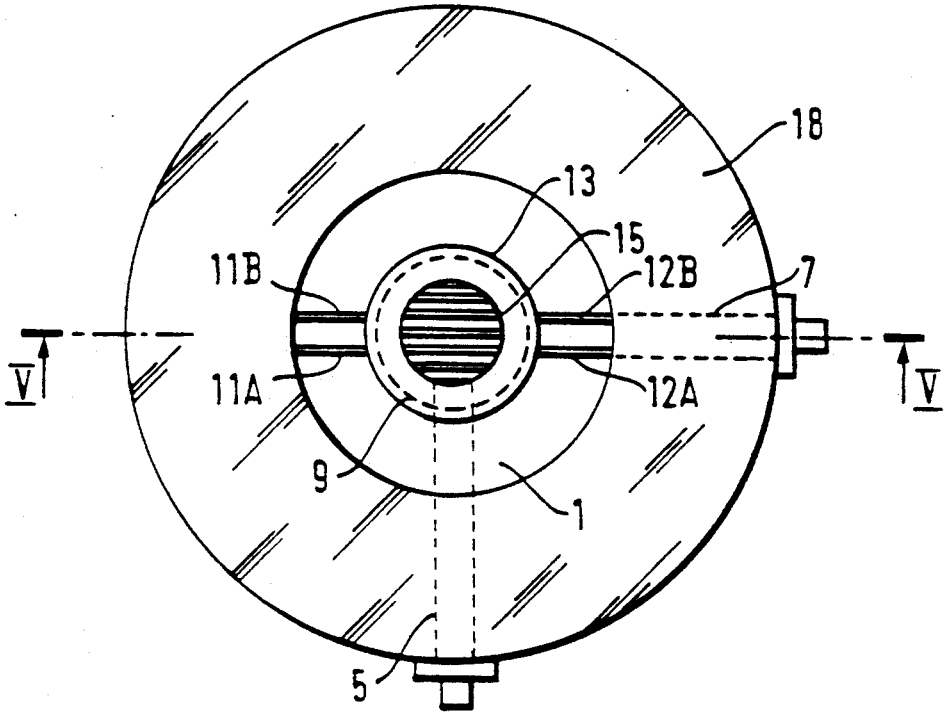
FIG. 4 is a plan view of a practical embodiment of the same antenna element.
Figure 5:
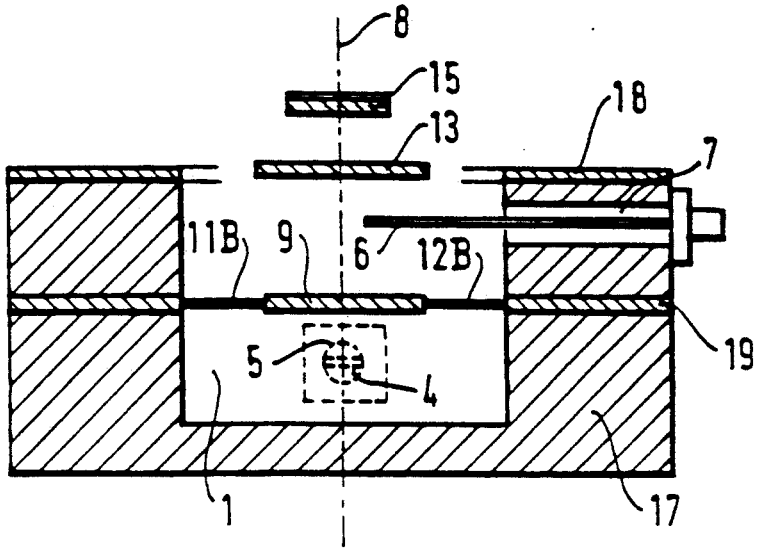
FIG. 5 is a view in section on V—V in FIG. 4.

A practical embodiment of the above-described antenna element is shown in FIGS. 4 and 5 in which corresponding components are designated by the same reference numerals.

In this embodiment, the cavity 1 is provided in a dielectric body 17 whose walls which should be at ground potential are either metal-plated or are covered with metal layers 18. In this embodiment, the two above-mentioned "lugs" 11 & 12 are each constituted by two spaced, parallel metal wires, respectively 11A & 11B and 12A & 12B which are bonded firstly to the central metal disk 9 and secondly to a metal ring 19 embedded in the body 17. Naturally, the members 13 and 15 are held in place by conventional insulating means (not shown).

Naturally, the invention is not limited to the above-described embodiment. The top selective patch 15 could be omitted so that the portion of the antenna that relates to the top probe 6 (microwave E2) would then not include a passive patch. Likewise, instead of strip-lines, other types of feed or reception lines could be used.

The geometrical shapes and contours of the cavity and its associated members may be other than as shown in this example. In particular, the cavity may be formed in a metal block.

In the same way, the patch 9 may be made in any manner, and in particular the electrical contacts 11 and 12 between the patch 9 and the sidewalls of the cavity 1 may be made in numerous ways.

The number of patches, whether polarization-selective or not, may be increased if need be. Other types of selective surfaces may be used. The two interlaced antennas may operate at different frequencies, and their orthogonal polarizations may be circular instead of linear. In particular, by feeding the two accesses 4 and 6 with signals in phase quadrature and of the same amplitude, e.g. via a 3 dB hybrid coupler, it is possible to make an element transmitting or receiving two highly-decoupled orthogonal circular polarizations via the accesses of the coupler.

In the same array, different radiating elements, such as radiating elements each having a single polarization, may be used in combination with dual-polarization elements of the invention.

The antenna may be use on its own or in an array to illuminate a focussing system.

We claim:

1. A microwave antenna element adapted to operate with first and second orthogonally-polarized microwave signals, said antenna element comprising a body having a cavity that is open in a radiation direction, said cavity including a bottom, a sidewall and a top opening, said top opening being open in a radiation direction, said cavity containing at least the following in succession, in a direction from said bottom towards said top opening:

a first, bottom probe capable of one of exciting and picking up said first microwave signal polarized in a first direction, said first, bottom probe being positioned adjacent to the bottom of said cavity; a polarization-selective first resonant obstacle which is shaped to and sized smaller than said cavity to constitute a patch type active resonator for said first microwave signal, and, to constitute a short-circuit plane for said second microwave signal polarized in an orthogonal manner relative to said first microwave signal;

a second, top probe capable of one of exciting and picking up said second microwave signal, and a second, patch type resonant obstacle which is not polarization-selective;

whereby said first resonant obstacle constitutes both an active resonator for the first microwave signal, and a short-circuit plane forming a cavity bottom for the second microwave signal, while said second resonant obstacle constitutes both a passive resonator for said first microwave signal and also an active resonator for said second microwave signal.

2. A microwave antenna element according to claim 1, wherein, downstream from said second resonant obstacle in the radiation direction, the antenna element further includes at least a polarization-selective third resonant obstacle which is of a shape so as to be transparent to said first microwave signal and further constitutes a patch type passive resonator for said second microwave signal.

3. An antenna element according to claim 1, wherein said first resonant obstacle is of circular shape and defines with said sidewall of said cavity at least one non-looped slot formed of at least two separate half-slots.

4. An antenna element according to claim 1, wherein said antenna element operates in circular polarization by the combination of said bottom and top probes.

* * * * *